United States Patent [19]

Beitler

[11] Patent Number: 5,052,118

[45] Date of Patent: Oct. 1, 1991

[54] MAT CUTTING LAYOUT APPARATUS

[75] Inventor: Edward R. Beitler, Creamery, Pa.

[73] Assignees: Edward Slater; Barbara J. Slater, both of Schwenksville, Pa.

[21] Appl. No.: 582,445

[22] Filed: Sep. 14, 1990

[51] Int. Cl.[5] ..... B43L 13/20

[52] U.S. Cl. ..... 33/563; 33/1 B; 33/574

[58] Field of Search ..... 33/562, 563, 564, 566, 33/565, 1 B, 1 F, 1 G, 474, 1 K, 666, 574

[56] References Cited

U.S. PATENT DOCUMENTS

| | | | |
|---|---|---|---|
| 513,665 | 1/1894 | Barberie | 33/47 X |
| 1,277,318 | 8/1918 | Johnson . | |
| 4,098,160 | 7/1978 | Well . | |
| 4,461,086 | 7/1984 | Segletes | 33/563 X |
| 4,704,796 | 11/1987 | Gauer . | |
| 4,827,620 | 5/1989 | Gauer . | |
| 4,936,020 | 6/1990 | Neblett | 33/566 |

FOREIGN PATENT DOCUMENTS

| | | | |
|---|---|---|---|
| 268259 | 10/1929 | Italy | 33/474 |
| Ad.10671 | of 1910 | United Kingdom | 33/1 R |
| 2110167 | 6/1983 | United Kingdom | 33/564 |

*Primary Examiner*—Harry N. Haroian
*Attorney, Agent, or Firm*—Michael F. Petock

[57] ABSTRACT

A template is provided for laying out cut lines for mats utilized in framing prints, stamps and the like. The template's outer dimension provides the outer dimension of the mat and a plurality of precisionly located holes are utilized to place marks on the mat, which marks are connected by lines which intersect with the matting being cut out along the intersecting lines to the intersection of the lines.

23 Claims, 4 Drawing Sheets

243
242
243
241
244
230
245
240
247
246
232
252
214A
238
253
251
258
259
254
255
261
260
250
256
236
257
214B
238B
259B
258B
261B
260B

MAT CUTTING LAYOUT APPARATUS

BACKGROUND OF THE INVENTION

The present invention is directed to an apparatus and method for laying out the cuts to be made in matting material.

There has been a need for a cost efficient means and method of laying out this matting material which provide high quality professional looking cuts in the matting in a rapid and time efficient manner.

In the past, the layout of the cut lines in the matting material was done by use of scales, rulers and straight edges in a time consuming manner and produced high quality results only if done with extreme care and with an extensive expenditure of man hours.

SUMMARY OF THE INVENTION

The present invention provides the advantage of providing a low cost apparatus for the laying out of cut lines in matting material for the framing of prints, stamps and the like.

A further advantage of the present invention is that it provides a means and a method of laying out the cutting for a high quality, professionally cut mat for the framing of prints, stamps and the like with a minimum of layout time.

The present invention provides a method and a means for the rapid, efficient and high quality layout of duck prints and duck stamp prints and/or other multiple prints on a single mat.

The present invention enables clean, crisp, clear cuts in the corners of the mat cut, in an efficient manner.

In accordance with the present invention, apparatus is provided for the laying out of cut lines to be made in a mat which include a template having two holes formed therein for each intersection of a pair of cut lines. The two holes are adapted to receive a marking means therethrough, such as a pencil point or the like. The two holes are formed in the template outside of the area to be cut and each of the two holes are so arranged to cooperate with one other hole in the template to form a straight line therebetween. The other holes are also adapted to receive a marking means therethrough. The straight lines connecting the two holes intersect to form an intersection which would correspond to a corner of a cut in the mat. The shape cut out may be any shape, such as triangular, rectangular, square or other shape.

However, in a preferred embodiment of the present invention, rectangular areas are contemplated to be cut out of a mat for the placement of duck prints and duck stamps for the matting and framing thereof. Such a template would be provided with eight holes formed therein for each rectangular (or square) area to be cut out. The holes are adapted to receive a marking means therethrough, such as a pencil lead. The holes are located outside of the area to be cut out and are so arranged so that two holes are located at each corner and so arranged to be outside of the area to be cut out. Each of the holes is adapted to cooperate with another hole located at another corner, so that the making of the marks through each of the holes and the joining of the marks with a straight line forms the cut lines of an area to be cut out with clean intersections at each corner.

In a preferred embodiment, eight such holes in the template would correspond to the duck print and eight such holes would correspond for each additional opening, such as for a duck stamp. However, it is understood that any type of painting, picture, print or other document or thing may be so mounted within the holes cut within the matting material, and such is not a limitation on the present invention.

Additionally, it is understood that an additional eight holes would be formed therein and so arranged and adapted to form a cut line outside of the cut out area enabling the formation of a V groove around the cut out area.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DETAILED DESCRIPTION OF THE PREFERRED EMBODIMENTS

Figure 1:
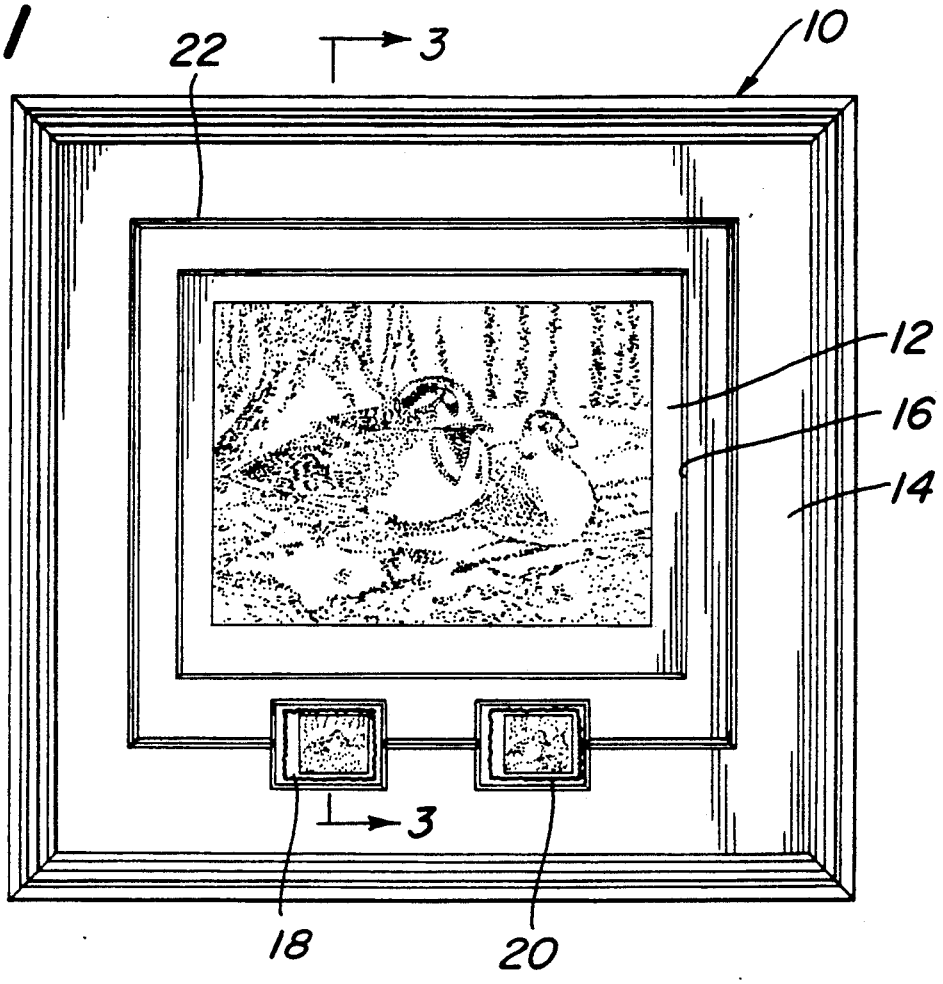
FIG. 1 is a plan view illustrating one example of the use of the present invention in a mat cut with multiple openings for duck prints and duck print stamps, including a V groove, which has been framed.
Figure 3:
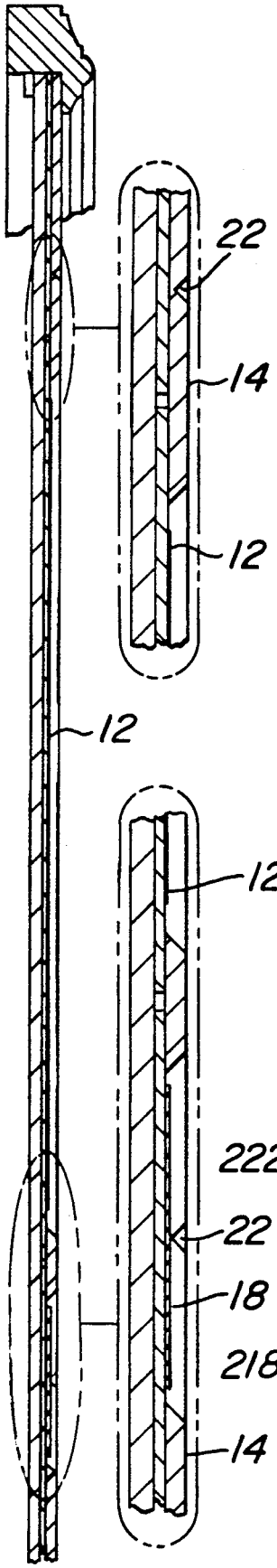
FIG. 3 is a cross sectional view taken along line 3—3 of FIG. 1 with exploded view portions thereof.

Referring now to the drawings in detail wherein like numerals indicate like elements, there is shown in FIG. 1 a matted and framed duck print 12 with two duck print stamps and a V groove 22. The duck print 12 is visible through the mat 14 with a cut out rectangular shape 16 in the mat 14. Print 12 has a white border. Two duck print stamps are shown at 18 and 20. A V groove is cut into mat 14 as shown at 22. The foregoing should be considered in conjunction with FIG. 3.

Figure 2A:
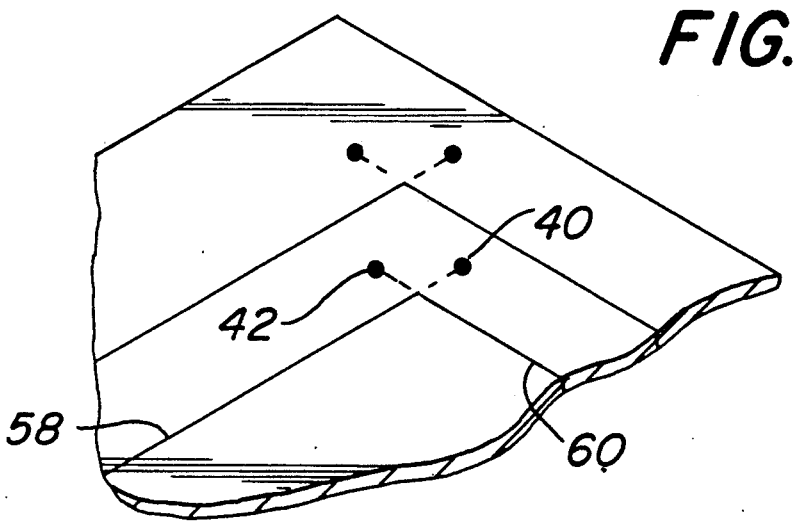
FIG. 2A is a broken away view showing two intersections of cut lines as laid out in accordance with the present invention.
Figure 2:
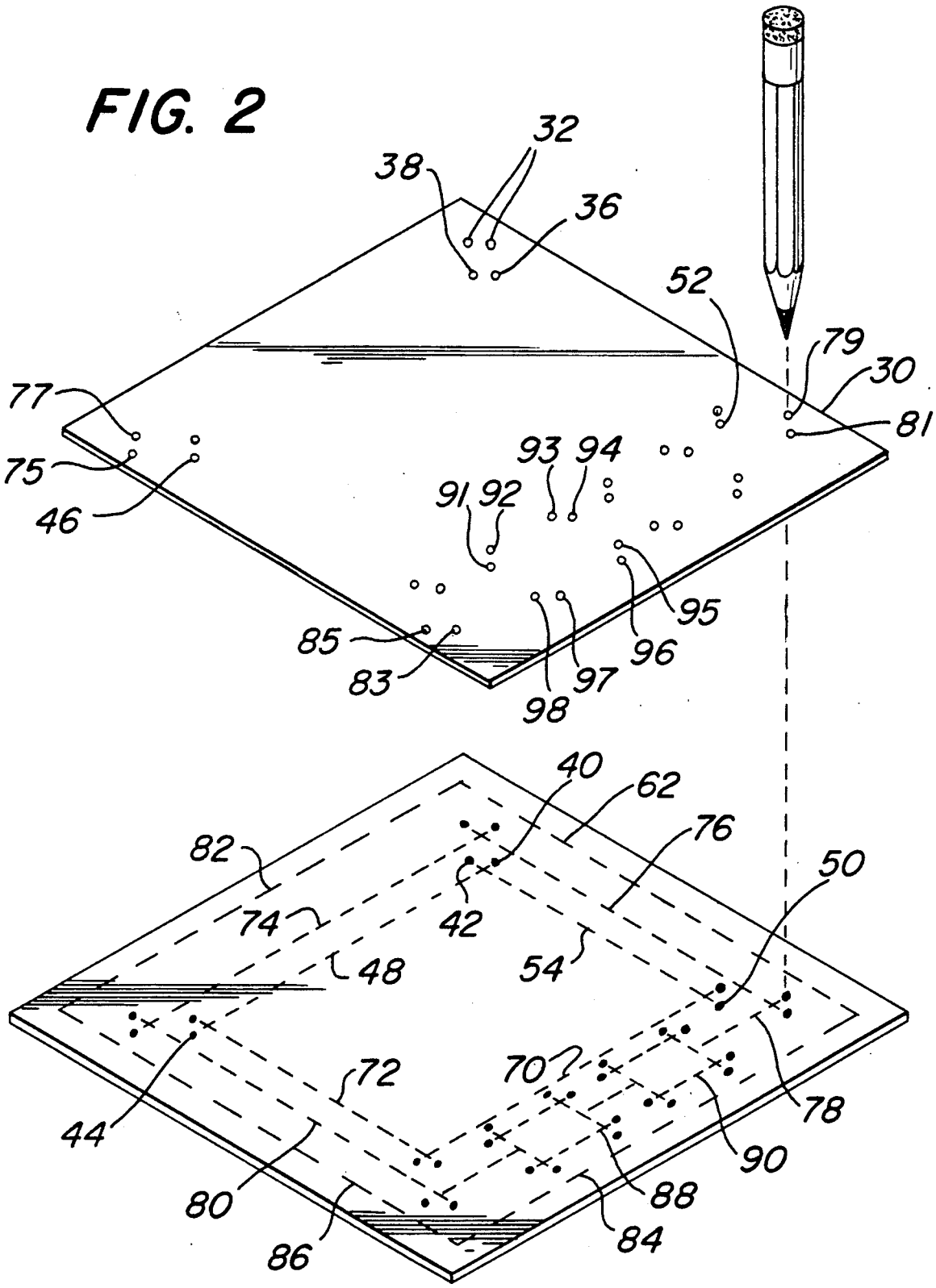
FIG. 2 is a view in perspective illustrating a template in accordance with the present invention and the actual lines along which the cuts are made to produce the mat illustrated in FIG. 1.

In accordance with the present invention, the layout lines for making the cuts in mat 12 are accomplished in an accurate and time efficient manner by use of a relatively inexpensive template 30 as illustrated in FIG. 2. Template 30 is provided with a plurality of holes which may be precision drilled or otherwise formed in template 30. Template 30 may be comprised of any suitable template material including various transparent plastics, and particularly thermoplastic poly(methyl methacrylate)-type polymers sold under the trademark "PLEXIGLAS". The template is preferably made of a transparent rigid material, and as presently preferred would be comprised of plexiglas between 1/16 and ⅛ of an inch thick. However, other suitable materials may be utilized, and it is not essential, although desirable, that template 30 be transparent. Preferably, the outer dimensions of template 30 would correspond to the outer dimension line 62 of mat 14 of FIG. 1. In this manner, the outline of template 30 could be drawn onto the mat material for the cutting of the mat material to the proper dimension for framing. There are two such holes 32 located outside of the area to be cut at each intersection. Holes 32 are adapted to receive a marker, such as a pencil, stencil or other marking means. In a preferred embodiment, a pencil point made of lead or other suitable marking material would be inserted through the holes to make a mark onto mat material 34. These holes are then connected with a corresponding hole at the other end to form straight lines as shown on mat 34.

More specifically, holes 36 and 38 which correspond to the upper right hand corner for the print, enable the making of the marks 40 and 42, respectively. Mark 40, by use of one of the edges of template 30 and a marker, will be connected by a line drawn to mark 44 which is formed by the use of hole 46 and template 30. These lines are shown as dotted lines on mat 34, and the line connecting marks 40 and 44 is illustrated as line 48. In a similar manner, mark 42 is connected to mark 50, which is formed by making a mark through hole 52. In this manner, clear intersection lines for the cutting out of the openings into the mat may be accomplished. For example, the cut lines are shown by solid lines in FIG. 2A, wherein solid cut line 58 corresponds to layout line 48 and solid cut line 60 corresponds to layout line 54.

Referring to FIG. 2, the cut lines for the mat would correspond to lines 48, 54, 70 and 72; being cut to the point of intersection with another line. In other words, they are not cut all the way to the marker points, such as 40 and 44. In a similar manner, the V-groove, for the layout shown in FIG. 1, is determined by layout lines 74, 76, 78 and 80 which are determined by marks made through holes 75, 77, 32, 79, 81, 83 and 85 in template 30. The outer dimensions of the mat 34, which corresponds to mat 14 in FIG. 1, are illustrated by lines 82, 62, 84 and 86. The outer lines 82, 62, 84 and 86 may be drawn by running the marker directly around the outer edge of template 30. In a manner similar to the creation of the layout lines for a large print, two smaller cutouts may be made at 88 and 90. For example, the layout lines for cut out 88 are constructed from marks made by a marker through holes 91 through 98 of template 30.

Figure 4:
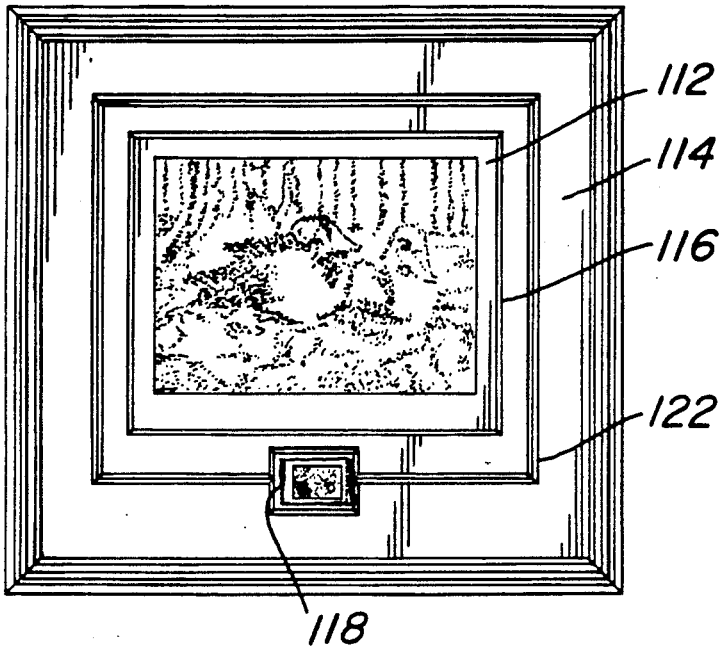
FIG. 4 is a plan view illustrating one example of the use of the present invention in a mat cut with a single duck stamp print, including a V groove, which has been framed.

The present invention may be utilized to lay out various arrangements of prints having multiple openings for multiple prints, stamps or other items to be framed. Of course, the specific hole arrangement on the template would be arranged to cover the particular matting arrangement. One such alternate arrangement is shown in FIG. 4 wherein a mat 114 is provided with two openings, one for a print 112 in which the mat opening starts at 116 and a second opening for a duck stamp print 118. The mat 114 of FIG. 4 is also provided with a V-groove 122. The V-grooves in all cases are optional, but they improve the appearance of the end product of the framed matted prints, stamps or other items.

Figure 5:
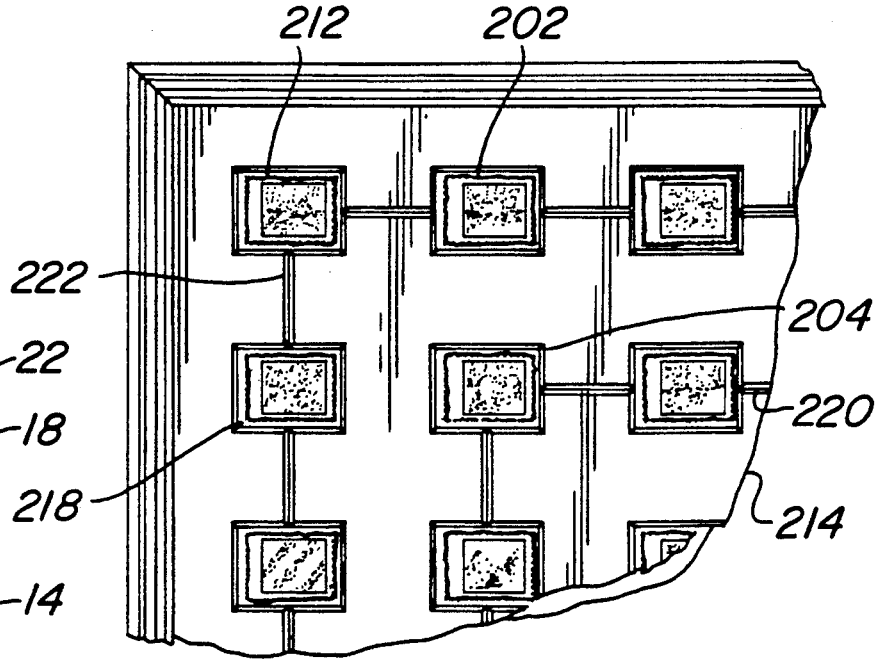
FIG. 5 is a plan view illustrating one example of the use of the present invention in a mat with multiple cut outs, including multiple V grooves, which has been framed.
Figure 6:
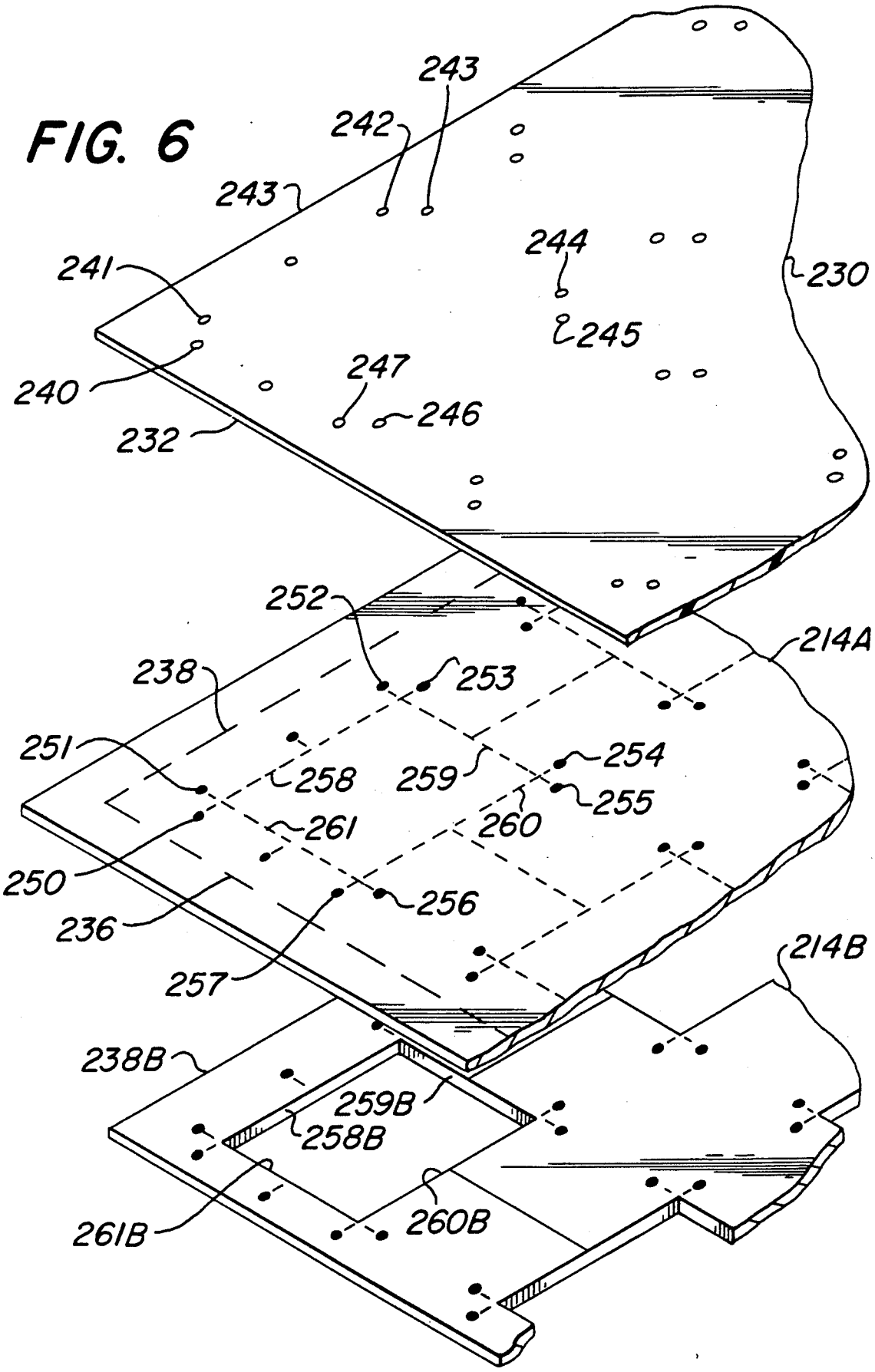
FIG. 6 is a view in perspective illustrating another embodiment of a template in accordance with the present invention, the layout lines on the mat and the cut lines illustrated on the mat.

Referring now to FIG. 5, there is shown another arrangement of multiple openings in a mat 214 for multiple prints, some of which are numbered as 202, 204, 212 and 218. The numbered ones correspond to the layout lines shown in the broken away FIG. 6 showing a broken away portion of the template, mat with layout lines and mat with cuts. Mat 214 is also provided with V-grooves 220 and 222.

Referring now to FIG. 6, there is shown a portion of a template 230 which would be utilized for the layout lines for cuts to be made in mat 214 for the matting of the framing of FIG. 5. In FIG. 6, the matting 214 is denominated 214A where the layout lines are shown and 214B where it has been cut to the outer dimension and the print spaces have been cut out.

In a manner similar to the procedure described with respect to FIGS. 2, 2A and 1, the layout lines are laid out on mat 214A and then the cuts are made in the mat as shown at 214B. Referring in some detail, a line would be drawn around the outer edge of template 230. For example, lines drawn along edges 232 and 234 of template 230 would result in layout lines 236 and 238, respectively. A marker inserted through holes 240 through 247 of template 230 would result in marker dots 250 through 257, respectively. As with respect to the description previously with respect to FIG. 2, the marker dots 250 through 257 may be made by pencil, pen or other suitable marker.

As with respect to FIG. 2, corresponding dots are connected together by a line and these lines intersect with other lines, the inner perimeter of these lines being where the cutting would take place. In other words, the marker dots are located outside of the cut area, and the lines extend to the marker dots. However, the cutting will end at the intersection of the lines, resulting in clean, crisp cuts of corners in the mat. More specifically, referring to FIG. 6, marker dots 250 and 253 are connected together to form line 258. Marker dots 252 and 255 are connected together to form line 259. Lines 258 and 259 intersect as shown. Marker dots 254 and 257 are connected together to form line 260. Marker dots 251 and 256 are connected together to form line 261. The lines intersect as shown, including lines 259 and 260 intersecting, 260 and 261 intersecting and lines 258 and 261 intersecting. All of the aforesaid lines may be conveniently made by utilizing one of the outer edges of template 230 to interconnect these lines. Preferably, this would be done after all of the dots have been placed on mat 214A. The template would then be moved around the mat and used as a straight edge, on which a pencil, or other marker, is utilized to run along one of the outer edges of template 230. V-groove layout line and the other connect lines for the other prints or stamps are made in a similar manner.

As shown on 214B, cuts are made along the lines to the intersections of the lines. The marker dots will remain, and may be removed by erasure. However, preferably, the marker dots are made on the backside of the mat which does not show. As may be readily seen from FIG. 6, cuts 258B, 259B, 260B and 261B correspond to lines 258 through 261, respectively. The outer dimensions of 214B are also shown to be cut to size, with edge 236B corresponding to line 236 and edge 238B corresponding to line 238.

In view of the above, the present invention may be embodied in other specific forms without departing from the spirit or essential attributes thereof and, accordingly, reference should be made to the appended claims, rather than to the foregoing specification as indicating the scope of the invention.

I claim:

1. Apparatus for the layout of cut lines to be made in a mat, comprising: a template having two holes formed therein for each intersection of a pair of cut lines, said two holes being adapted to receive a marking means therethrough, said two holes being outside of an area to be cut and each of said two holes being so arranged to cooperate with one other hole to form a straight line therebetween, said other holes also being adapted to receive a marking means therethrough, the straight lines corresponding to said two holes intersecting to form an intersection which will form a corner of a cut in said mat, said template being provided with eight holes therein for the cutout of each area, said template being provided with holes adapted to lay out the cutout of multiple areas, there being eight holes for each of said multiple areas.

2. Apparatus in accordance with claim 1 wherein said template is provided with a set of eight holes adapted and arranged outside of at least one cutout area for the layout of a V groove around said cutout area to be cut out.

3. Apparatus in accordance with claim 1 wherein said template is comprised of a synthetic plastic material.

4. Apparatus in accordance with claim 3 wherein said synthetic plastic material is transparent.

5. Apparatus in accordance with claim 3 wherein said synthetic plastic material is a thermoplastic poly-(methyl methacrylate)-type polymer.

6. Apparatus for the layout of lines for the cutting of a rectangular or square opening in a mat, comprising: a template having eight holes formed therein for an area to be cut out, said holes being adapted to receive a marking means therethrough, said holes being located outside of the said area to be cut out and so arranged so that two holes are located at each corner and so arranged to be outside of the area to be cut out and adapted to cooperate with holes located at other corners so that the making of marks through each of said holes and adjoining of said marks with a straight line forms the cut lines of an area to be cut out with clean intersections at each corner, said template being provided with an outer edge corresponding to the outer edge size of the mat as it is to be framed wherein said outer edge of said template may be used to trace the outer edge of said mat and said two holes at each corner may be used to layout said opening.

7. Apparatus in accordance with claim 6 wherein multiple areas are to be cut out on a single mat, each provided with eight holes through the template for each such area to be cut out.

8. Apparatus in accordance with claim 6 including eight additional holes formed therein and so arranged and adapted to form a cut line outside of said cut out area enabling the formation of a V groove.

9. Apparatus in accordance with Claim 6 wherein said template is comprised of a synthetic plastic material.

10. Apparatus in accordance with Claim 9 wherein said synthetic plastic material is transparent.

11. Apparatus in accordance with Claim 9 wherein said synthetic plastic material is a thermoplastic poly-(methyl methacrylate)-type polymer.

12. A method of laying out cut lines to be made in a mat, comprising the steps of:

utilizing a template having holes therein located beyond the area to be cut out;

marking through said holes to form marks outside of the area to be cut in the mat to form two marks outside of each corner to be cut;

connecting said marks with straight lines to form clean intersecting lines to form the corners of the cut; and cutting along each of said lines to the point of an intersecting line.

13. A method in accordance with Claim 12 including the additional step of repeating said process to form multiple cut outs in said mat.

14. A method in accordance with Claim 12 including the additional step of utilizing a template having an additional set of holes located beyond the area to be cut out and beyond said previously recited template holes, marking through said additional set of holes, connecting said marks and cutting along each of said lines to the points of intersecting lines to form a V groove along the area to be cut out.

15. Apparatus for the the layout of cut lines to be made in a mat for framing, comprising: a template for the layout of cut lines for multiple openings in a single mat having a pair of holes therein for each intersection of a pair of cut lines, said pair of holes being adapted to receive a marker therethrough, said pair of holes being outside of an area to be cut and each of said pair of holes being arranged to cooperate with one other hole to form a straight line therebetween, said other holes being adapted to receive a marker therethrough, the straight lines corresponding to said two holes of said pair of holes intersecting to form an intersection which will form a corner of a cut out in said mat, said template being provided with a plurality of pairs of holes for each of said multiple openings to be cut in the mat.

16. Apparatus in accordance with claim 15 wherein said template is provided with an outer edge corresponding to the outer edge size of the mat as it is to be framed wherein said outer edge of said template may be used to trace the outer edge of said mat and said pairs of holes may be used to layout said multiple openings.

17. Apparatus for the layout of cut out lines to be made in a mat for framing, comprising: a template for the layout of cut lines for two or more rectangular cut outs and at least one V groove, said template being provided with a pair of holes therein for each intersection of a pair of cut lines such that eight holes are provided therein for the layout of the cut out for each rectangular area and a set of eight holes for the lay out of the cut lines for the V groove, said holes being adapted to receive a marker therethrough, said pair of holes being outside each area to be cut and each of said pair of holes being so arranged to cooperate with one other hole of its corresponding group of eight to form a straight line therebetween, said other holes also being adapted to receive a marker therethrough, the straight lines corresponding to said two holes intersecting to form an intersection which will form a corner of a cut in said mat.

18. Apparatus in accordance with claim 17 wherein said template is provided with an outer edge corresponding to the outer edge size of the mat as it is to be framed wherein said outer edge of said template may be used to trace the outer edge of said mat and said pairs of holes may be used to layout said multiple openings.

19. Apparatus in accordance with claim 17 wherein said template is provided with holes for the lay out of a substantially centered duck stamp print and for a least one additional opening for a duck stamp, said V groove surrounding said opening for said duck stamp print and intersecting the opening for said duck stamp.

20. Apparatus in accordance with claim 17 wherein said template is provided with holes for the laying out of a substantially centered duck stamp print and at least two additional openings for a duck stamps, said V groove surrounding said opening for said duck stamp print and intersecting the openings for said duck stamps.

21. Apparatus in accordance with claim 17 wherein said template is provided with holes for laying out of a plurality of openings for duck stamps.

22. Apparatus in accordance with claim 21 wherein said template is provided with holes for laying out of a V groove which intersects the openings for said duck stamps.

23. Apparatus in accordance with claim 21 wherein said template is provided with holes for the laying out of more than three openings for duck stamps, and includes holes for the laying out of a V groove which intersects said openings for said duck stamps.

* * * * *